US006761815B2

(12) United States Patent
Nakajima et al.

(10) Patent No.: US 6,761,815 B2
(45) Date of Patent: Jul. 13, 2004

(54) PROCESS FOR THE PRODUCTION OF HYDROGEN PEROXIDE SOLUTION

(75) Inventors: Yasuo Nakajima, Fujisawa (JP); Yoshinori Nishiki, Fujisawa (JP); Masaharu Uno, Fujisawa (JP); Akira Katsumoto, Osaka (JP); Kunio Nishimura, Osaka (JP)

(73) Assignees: Permelec Electrode Ltd., Kanagawa (JP); Katayama Chemical Inc., Osaka (JP)

( * ) Notice: Subject to any disclaimer, the term of this patent is extended or adjusted under 35 U.S.C. 154(b) by 164 days.

(21) Appl. No.: 10/095,482

(22) Filed: Mar. 13, 2002

(65) Prior Publication Data

US 2002/0130048 A1 Sep. 19, 2002

(30) Foreign Application Priority Data

Mar. 14, 2001 (JP) ..... P. 2001-072091

(51) Int. Cl.[7] ..... C25B 1/00

(52) U.S. Cl. ..... 205/466; 205/465

(58) Field of Search ..... 205/466, 465

(56) References Cited

U.S. PATENT DOCUMENTS 6,113,773 A * 9/2000 Shimamune et al. ..... 205/466
6,547,947 B1 * 4/2003 Uno et al. ..... 205/466

FOREIGN PATENT DOCUMENTS

JP 11-158674 * 6/1999

* cited by examiner

*Primary Examiner*—Arun S. Phasge
(74) *Attorney, Agent, or Firm*—Sughrue Mion, PLLC

(57) ABSTRACT

A process for the production of hydrogen peroxide solution from seawater as a starting material substantially free of effective chlorine or organic halogen compounds. An electric current is passed through an insoluble anode and an oxygen gas diffusion cathode while keeping the halide ion concentration of anolyte supplied to the anode chamber to a level not greater than 1 g/l. Hydrogen peroxide thus generated dissolves in the catholyte. Anodic oxidation of halide ions is suppressed, to thereby inhibit the production of effective chlorine.

6 Claims, 1 Drawing Sheet

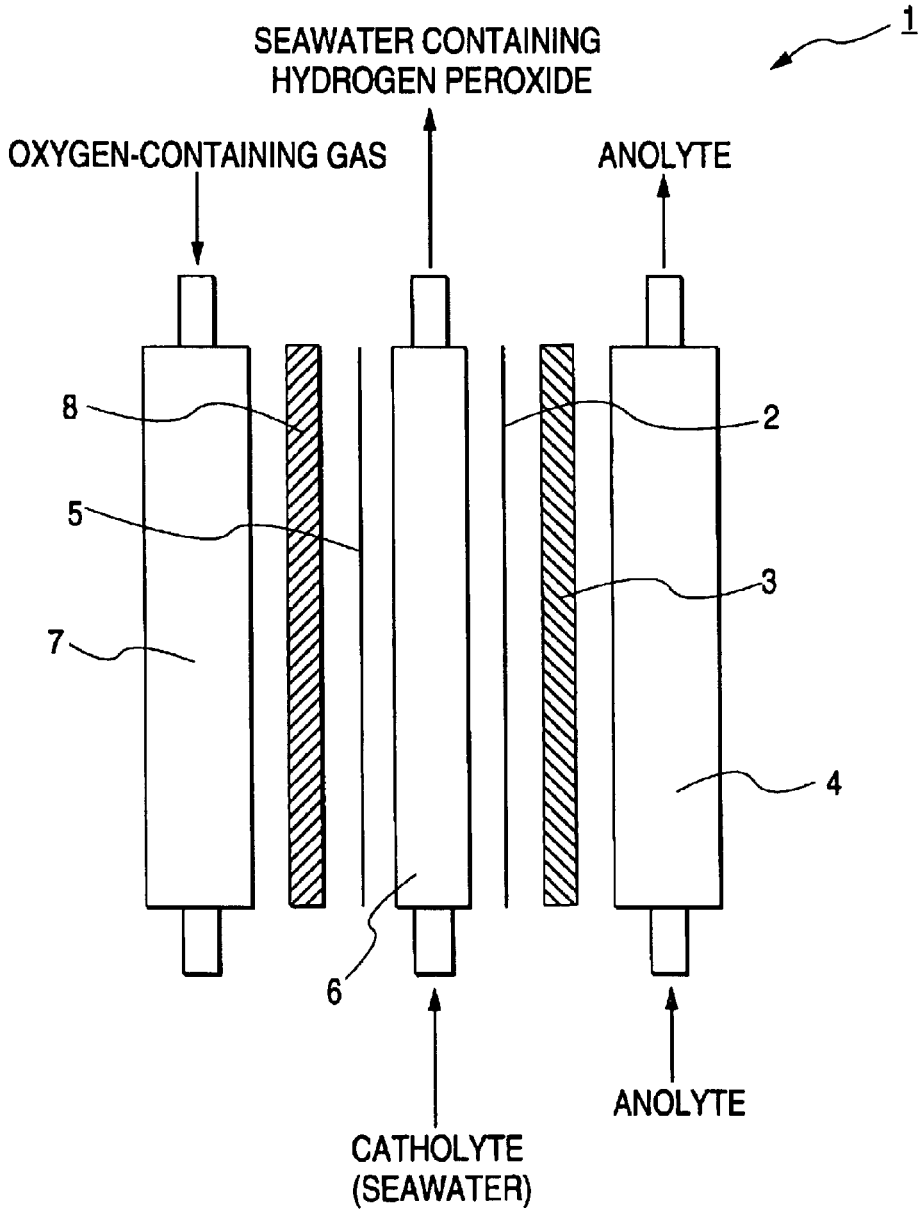
1
SEAWATER CONTAINING
HYDROGEN PEROXIDE
OXYGEN-CONTAINING GAS
ANOLYTE
8
2
5
3
7
4
6
ANOLYTE
CATHOLYTE
(SEAWATER)

PROCESS FOR THE PRODUCTION OF HYDROGEN PEROXIDE SOLUTION

FIELD OF THE INVENTION

The present invention relates to a process for the production of a hydrogen peroxide solution which includes electrolyzing seawater to produce hydrogen peroxide with secondary production of effective chlorine or organic halogen compound in a minimized amount.

BACKGROUND OF THE INVENTION

Due to concern that the pollution and the deterioration of water quality of rivers and lakes caused by industrial and household wastes can have adverse effects on the environment and human body, technical countermeasures for solving these problems are urgently needed. In the treatment of drinking water, sewage and waste water, the practice has been to add a chemical such as chlorine to decolor and sterilize the water to be treated and reduce the COD thereof. However, since the addition of a large amount of chlorine causes the production of harmful materials, i.e., environmental hormones (extrinsic incretion disturbing material) and carcinogenic substances, the recent trend is to add less chlorine.

Further, under some combustion conditions, the incineration of waste can cause the production of carcinogenic substances (dioxins) which affect the ecosystem and thus has been noted as a safety problem. In order to solve the problems of water treatment, the following water treatment processes have been proposed.

An example of chemicals suitable for sterilization in water treatment is hydrogen peroxide. Hydrogen peroxide is useful as a fundamental chemical indispensable for treatment in the fields of food, medicine, pulp, fiber and semiconductors in addition to water treatment. In particular, noted future uses of hydrogen peroxide include cleaning of electronic parts and sterilization of medical equipment and facilities. At present, hydrogen peroxide is produced in a large amount by an anthraquinone process.

In power plants and factories using seawater as cooling water, it has been heretofore practiced to directly electrolyze seawater to produce hypochlorous acid which is then effectively used to prevent the attachment of organisms such as barnacles and alga to the interior of the condenser.

However, when hypochlorous acid is discharged untreated, it decomposes to produce organic chlorine compounds and chlorine gas, which are considerably harmful to the environment. Stricter regulations have been imposed on the discharge of hypochlorous acid.

On the other hand, it has been reported that addition of hydrogen peroxide to cooling water effectively prevents the attachment of living organisms. Further, hydrogen peroxide decomposes to water and oxygen, which are harmless and raise no environmental and hygienic problems.

However, hydrogen peroxide is too unstable to store over an extended period of time. Also, from the standpoint of safety and anti-pollution measures, there has been a growing demand for an on-site device. An electrolysis process has been proposed as an on-site process for the production of hydrogen peroxide.

An electrolysis process can utilize clean electric energy to carry out a desired electrochemical reaction. By controlling the chemical reaction on the surface of the cathode, the electrolysis can produce hydrogen peroxide. Water treatment involving the decomposition of contaminants by this electrolysis process has long been widely practiced. This electrolysis process allows onsite production of hydrogen peroxide, eliminating the disadvantage of hydrogen peroxide with respect to poor storage stability in the absence of a stabilizer, the danger in transportation and the necessity of anti-pollution measures.

Referring to the production of hydrogen peroxide by electrolysis, various electrolytic production processes are described for comparison in *Journal of Applied Electrochemistry*, Vol. 25, 613-(1995). All these processes allow efficient production of hydrogen peroxide in an atmosphere of an alkaline aqueous solution and thus require the supply of an alkaline component as a starting material. Thus, an aqueous solution of an alkali such as KOH and NaOH is essential. As an example of the decomposition of an organic compound by hydrogen peroxide, the decomposition of formaldehyde is described in *Journal of Electrochemical Society*, Vol. 140, 1,632-(1993). *Journal of Electrochemical Society*, Vol. 141, 174-(1994), proposes a method which comprises electrolysis of purified water as a starting material using an ion exchange membrane wherein ozone and hydrogen peroxide are synthesized at the anode and the cathode, respectively. However, this method has a low current efficiency and thus is not practical. It has been reported that a similar method can be effected under high pressure to raise the current efficiency. However, this proposal, too, is not practical from the standpoint of safety. An electrolysis process using palladium foil has been proposed. However, this electrolysis process is limited in its use because it can produce hydrogen peroxide only in a low concentration and adds to cost.

When seawater is subjected to electrolysis as an electrolyte with oxygen present on the cathode side, the resulting hydrogen peroxide is dissolved in the seawater to produce a hydrogen peroxide solution. In this manner, the hydrogen peroxide and a superoxide anion ($O_2^-$) produced therewith sterilize microorganisms in the seawater to obtain a hydrogen peroxide solution having high purity. When the anode used for this electrolysis process is a commercial oxygen producing electrode, halide ions in the seawater, i.e., chloride ions in a high concentration and fluoride ions, bromide ions and iodide ions in a slight amount are oxidized at the anode to produce a halogen gas such as chlorine gas or a hypohalogenous acid such as hypochlorous acid. Even when an electrode which resists the generation of chlorine gas or the like is used or when a cation exchange membrane is used to separate the cathode from the anode, which is a site for the production of chlorine gas, the oxidation of chloride ions or the like cannot be completely prevented.

Further, chlorine gas or the like is likely to react with organic compounds in the seawater to produce a harmful trihalomethane (THM). In order to prevent the production of THM, water treatment may be effected using a hydrogen gas anode while supplying hydrogen gas (Japanese Patent Laid-Open No. 1998-121281). In this manner, the oxidation of chloride ion (i.e., production of chlorine gas or hypochlorous acid) can be inhibited, making it possible to eliminate the source of THM. However, this method requires the installation of a hydrogen gas anode and the supply of hydrogen gas, adding to cost. Thus, this method is not economical. Further, this method involves a danger in handling hydrogen gas.

It is also known that organic compounds in seawater partly undergo oxidative destruction at the anode to produce chlorine. To solve this problem, one technique proposes the use of an insoluble anode which resists the production of chlorine gas and an ion exchange membrane (Japanese Patent Laid-Open No. 1999-158674). However, because seawater containing a large amount of organic compounds is used as an anolyte, the production of THM is unavoidable.

As discussed above, when seawater containing an organic compound and halide ions is subjected to electrolysis in a conventional manner to produce seawater containing hydrogen peroxide, the production of organic halogen compounds such as THM unavoidably occurs, raising a great environmental and hygienic problem.

SUMMARY OF THE INVENTION

It is therefore an object of the invention to provide a process for the production of a hydrogen peroxide solution using a solution having a low halide ion concentration as an anolyte for the production of seawater containing hydrogen peroxide by the electrolysis of seawater. The process of the invention practically avoids the production of effective chlorine or THM, which is unavoidable in conventional processes for the production of hydrogen peroxide solution from seawater.

The above object of the present invention will become apparent from the following detailed description and Examples.

The invention provides a process for the production of hydrogen peroxide solution which comprises effecting electrolysis while supplying an anolyte, a catholyte and an oxygen-containing gas to an anode chamber having an insoluble anode, a solution chamber and a gas chamber, respectively, of a hydrogen peroxide producing electrolytic cell to produce a hydrogen peroxide solution. The hydrogen peroxide producing electrolytic cell is partitioned by a membrane into an anode chamber and a cathode chamber housing a gas diffusion cathode. The gas diffusion cathode partitions the cathode chamber into a solution chamber and a gas chamber. Furthermore, the catholyte is seawater and the concentration of halide ion in the anolyte is not greater than 1 g/l.

BRIEF DESCRIPTION OF THE DRAWING

By way of example and to make the description more clear, reference is made to the accompanying drawing in which:

The FIGURE is an exploded longitudinal sectional view illustrating an example of an electrolytic cell which can be used in the process of the invention, wherein reference numeral 1 indicates an electrolytic cell, the reference numeral 2 indicates a cation exchange membrane, the reference numeral 3 indicates an anode, the reference numeral 4 indicates an anode chamber, the reference numeral 5 indicates an oxygen gas electrode, the reference numeral 6 indicates a solution chamber, and the reference numeral 7 indicates a gas chamber.

DETAILED DESCRIPTION OF THE INVENTION

The invention will be described in greater detail below.

Unlike a conventional process for the production of hydrogen peroxide solution by the electrolysis of seawater involving the supply of seawater into both the anode chamber and cathode chamber, the process of the invention comprises supplying an anolyte having a halide ion concentration of not greater than 1 g/l to the anode chamber, to obtain a hydrogen peroxide solution while minimizing the production of effective chlorine and organic halogen compounds. As used herein, "effective chlorine" is the oxidation product of halide ion and an organic halogen compound is the reaction product of effective chlorine with an organic compound.

The total organic carbon content (TOC) in seawater is about 10 ppm, although this depends on the site where it is collected.

Regulations on trihalomethane compound in public water areas have been established to eliminate the effect on the human body and other living beings. For example, the maximum allowable concentration of trichloroethylene and tetrachloroethylene are 0.03 mg/l and 0.01 mg/l, respectively. It is thus difficult to keep the concentration of THM produced by the reaction of organic (TOC) component in seawater with chlorine gas or hypochlorous acid (produced by electrolysis or by direct electrolytic oxidation reaction of an effective chlorine component with an organic carbon component) to not greater than the above standard.

When seawater having a TOC of about 10 ppm is subjected to electrolysis, chlorine gas or hypochlorous acid produced by the oxidation of chloride ion chlorinates an organic compound to produce THM. Accordingly, a conventional electrolysis process which comprises effecting electrolysis while supplying seawater to the anode chamber and cathode chamber to obtain a hydrogen peroxide solution is unavoidably subject to the production of effective chlorine in the anode chamber, in which electrolytic oxidation occurs, and THM by the chlorination of an organic compound by the effective chlorine.

In the invention, on the contrary, the concentration of halide ion in the anolyte present in the anode chamber is minimized, i.e., kept to not greater than 1 g/l to avoid the oxidation reaction of halide ion in the anode chamber, which would otherwise cause the production of a large amount of THM. In the case where purified water, tap water, industrial water or the like is used, a neutral salt such as sodium sulfate and sodium nitrate or an alkaline or acidic supporting electrolyte such as sodium hydroxide and sulfuric acid may be added to render the water electrically conductive. In order to inhibit the accumulation of halide ion in the anode chamber, the anolyte is preferably supplied continuously at a linear rate of from 1 to 100 cm/min.

Even when the electrolyte of the invention having a minimized halide ion concentration is used, effective chlorine is somewhat produced unless the halide ion concentration is zero. Even if effective chlorine is generated in a small amount, no organic halogen compounds such as THM are produced because anolytes other than ordinary seawater contain little or no organic compounds. Organic halogen compounds, if produced, have no adverse effect on the environment or the human body because effective chlorine, from which they are produced, occurs only in a slight amount.

When the anolyte and catholyte are mixed to give a hydrogen peroxide solution, a slight amount of effective chloride which may be contained in the anolyte is decomposed by hydrogen peroxide present in a large amount in the catholyte, substantially inhibiting the production of organic halogen compounds and hence making it possible to provide a hydrogen peroxide solution free of harmful organic halogen compounds.

In general, effective chlorine is not produced in the cathode chamber. Thus, even when organic compounds are present, no organic halogen compounds are produced. However, the seawater supplied into the solution chamber preferably is previously freed of organic compounds, making it also possible to inhibit the production of organic halogen compounds by external effective chlorine or the like.

In the invention, the seawater in an amount corresponding to the required production amount need not be totally supplied to the solution chamber of the electrolytic cell. In other words, when a large amount of seawater containing hydrogen peroxide is produced, the seawater as a starting material is partially branched. The seawater thus branched is freed of organic compounds and is subjected to electrolysis to produce hydrogen peroxide which is then dissolved therein to provide seawater containing hydrogen peroxide. When the seawater is then mixed with the unbranched seawater, diluted seawater containing hydrogen peroxide substantially free of organic halogen compounds is obtained.

The amount of hydrogen peroxide to be contained in seawater which can inhibit the proliferation of organisms is about 1 ppm. The concentration of hydrogen peroxide solution obtained by electrolysis is about 1,000 ppm. Accordingly, even if the hydrogen peroxide solution produced by electrolysis is diluted 1,000 times, it can effectively inhibit the proliferation of organisms. In other words, when $1/1{,}000$ of the seawater collected is branched for electrolysis, and then mixed with the rest ($999/1{,}000$) of the seawater, which has not been branched, seawater having hydrogen peroxide dissolved therein in a required concentration is obtained. Thus, a desired hydrogen peroxide solution can be obtained by minimized electrolysis of seawater. The dilution of electrolyzed seawater by a factor of 1,000 means that THM contained therein, too, is diluted 1,000 times. If the electrolyzed seawater contains THM in an amount of 10 ppb, the concentration of THM in the seawater thus diluted 1,000 times is as low as 0.01 ppb. Further, since the amount of seawater to be electrolyzed is 0.1% of the total amount of seawater collected, it has little or no effect on the quality of seawater.

The electrolytic cell for use in the process of the invention is not specifically limited so far as it is adapted for the production of hydrogen peroxide. For example, the following electrolytic cell can be used.

The anode for use in the electrolytic cell is an insoluble anode. It eliminates disadvantages of installation of a gas diffusion electrode and the need to supply dangerous hydrogen gas to the hydrogen gas anode. The cathode is an oxygen gas diffusion cathode which efficiently produces hydrogen peroxide by the reduction of oxygen gas.

The catalyst for the oxygen gas electrode is preferably a metal such as gold, an oxide thereof or carbon such as graphite and electrically-conductive diamond. The oxygen gas electrode may have an organic material such as polyaniline and thiol (organic compound containing —SH group) coated thereon. The catalyst may be used in sheet form or porous form. Alternatively, the catalyst may be supported on a plate, metal gauge, sintered powder or sintered metal fiber of a corrosion-resistant material such as stainless steel, zirconium, silver and carbon in an amount of from 1 to 1,000 $g/m^2$ by a thermal decomposition method, resin fixing method, composite plating method or the like. By forming a hydrophobic sheet on the side of the cathode opposite the anode, the supply of gas to the reactive surface can be controlled to advantage.

The negative electric supplier to the oxygen gas electrode is a metal such as carbon, nickel, stainless steel and titanium or alloy or oxide thereof preferably in a porous or sheet form. In order to supply and withdraw reaction product gas and electrolyte smoothly, a dispersed hydrophilic or hydrophobic material is preferably supported on the surface of the electric supplier.

When the electrical conductivity of the catholyte is low, it raises the cell voltage or shortens the life of electrode. In this case, the electrolytic cell is preferably arranged such that the oxygen gas diffusion cathode is as close as possible to the ion exchange membrane (the width of the solution chamber is reduced) for the purpose of inhibiting contamination by the material of the gas electrode and for other purposes.

The amount of oxygen supplied to the cathode is preferably from the same as to about twice the theoretical value. The oxygen source may be air, a commercially available oxygen cylinder, oxygen produced by the electrolysis of water in a separately installed electrolytic cell or oxygen obtained by concentrating air using a PSA (pressure swing adsorption) device. In general, as the oxygen concentration is increased, the hydrogen peroxide solution can be produced at a higher current density.

The use of the membrane to separate the anode chamber from the cathode chamber makes it possible to retain the active material produced by the electrode reaction stably away from the counter electrode and accelerate electrolysis rapidly even if the electrical conductivity of the electrolyte is low. The membrane may be a neutral membrane or an ion exchange membrane. In particular, a cation exchange membrane is preferably used to prevent oxidation of halide ion on the anode. The membrane may be made of a fluororesin or a hydrocarbon-based material. From the standpoint of corrosion resistance, the former material is preferred.

For stability, the anode catalyst may be a noble metal such as iridium, platinum and ruthenium or a composite oxide comprising an oxide thereof and an oxide of a valve metal such as titanium and tantalum. The catalyst is preferably selected such that the oxygen production reaction, which is a water oxidation reaction, occurs in preference to the production of halogen gas or hypochlorous acid by the oxidation of halide ion. It is known that the use of manganese dioxide or a composite oxide such as manganese-vanadium oxide, manganese-molybdenum oxide and manganese-tungsten oxide makes it possible to inhibit the generation of halogen gas from the oxidation of halide ion. By dipping an electrode substrate such as titanium in an aqueous solution having the above ions dissolved therein, the foregoing anode catalyst can be formed on the surface of the substrate in an amount of from 1 to 1,000 $g/m^2$.

Referring to the electrolysis conditions, the solution temperature is preferably from 5° C. to 60° C., and the current density is preferably from 0.1 to 100 $A/dm^2$. The distance between the electrodes is preferably reduced to lower the resistance loss. The distance between the electrodes is preferably from 1 to 50 mm to reduce the pressure loss of the pump for supplying the electrolyte and to keep the pressure distribution uniform.

The electrolytic cell is preferably constructed of a glass lining material, carbon, or corrosion-resistant titanium, stainless steel or PTFE resin from the standpoint of durability and stability of hydrogen peroxide. The concentration of hydrogen peroxide thus produced can be controlled to a range of from 10 ppm to 10,000 ppm (1% by weight) by adjusting the amount of supply water and the current density.

When seawater is electrolyzed, hydroxides or carbonates of calcium or magnesium are gradually deposited on the surface of the cathode. In order to remove these salts, preferably the electrolytic cell is regularly washed with hydrochloric acid or a chelating agent is regularly injected into the electrolytic cell.

A preferred embodiment of the electrolytic cell for use in the process of the invention for the production of hydrogen peroxide solution will be described in detail with reference to the accompanying Figure.

The Figure is an exploded longitudinal sectional view illustrating an embodiment of the electrolytic cell adapted for the production of seawater containing hydrogen peroxide by the process of the invention.

Electrolytic cell 1 is a two chamber type electrolytic cell partitioned by a cation exchange membrane 2 into an anode chamber 4 having an anode 3 in the form of a porous sheet and a cathode chamber. An oxygen gas electrode 5 is used as the cathode. The oxygen gas electrode 5 partitions the cathode chamber into a solution chamber 6 on the cation exchange membrane side and a gas chamber 7 on the opposite side.

An anolyte having a halide ion concentration of not greater than 1 g/l such as purified water and tap water is supplied to the anode chamber 4.

An electric current is supplied to the oxygen gas electrode 5 from a porous electric supplier 8 disposed in close contact with the back side thereof. An oxygen-containing gas such as oxygen gas is supplied through an oxygen gas feed pipe disposed on the back side of the oxygen gas electrode 5. The oxygen-containing gas thus supplied passes through the oxygen gas electrode 5. During this process, the oxygen-containing gas is partly reduced by the electrode catalyst to hydrogen peroxide which reaches the solution chamber 6. On the other hand, seawater freed of organic compound is preferably supplied to the solution chamber 6. Hydrogen peroxide produced by the oxygen gas electrode 5 is dissolved in the seawater in the solution chamber 6 to provide a hydrogen peroxide solution which is then withdrawn from the electrolytic cell 1 through a hydrogen peroxide outlet pipe.

The seawater contains chloride ions. Accordingly, when the seawater as a catholyte partly moves to the anode chamber 4 through the cation exchange membrane 2 to undergo anodic oxidation, chlorine gas or hypochlorous acid is produced. The chlorine gas or the like does not produce THM or the like because the seawater is substantially free of organic compounds. Instead, the chlorine gas or the like reacts with hydrogen peroxide produced in the cathode chamber and is consumed. Accordingly, the hydrogen peroxide solution withdrawn from the electrolytic cell is substantially free of chlorine.

Thus, seawater containing hydrogen peroxide free of effective chlorine or organic halogen compounds can be obtained from the cathode chamber. Since the anolyte originally has a low halide ion concentration, anodic oxidation does not cause the production of effective chlorine to an extent such that the environment and human body are adversely affected. Accordingly, both the seawater containing hydrogen peroxide obtained in the cathode chamber and the hydrogen peroxide solution obtained by mixing the seawater and the anolyte are substantially free of organic halogen compounds. Thus, a stable hydrogen peroxide solution having a high detergency can be safely obtained from seawater having a high halide ion concentration.

The invention will be further described in the following Examples of the process for the production of hydrogen peroxide solution according to the invention, but the invention should not be construed as being limited thereto. The content of THM in water as a starting material such as tap water, industrial water and seawater was below the limit of detection.

EXAMPLE 1

An iridium oxide catalyst was supported on a porous titanium sheet in an amount of 10 g/m$^2$ by a thermal decomposition method to prepare an anode.

A carbon powder (Type XC-72 furnace black, produced by Vulcan Inc. of U.S.A.) as a catalyst was kneaded with a PTFE resin. The mixture was applied to a carbon cloth (produced by Nippon Carbon Co., Ltd.), and then calcined at a temperature of 330° C. to prepare a sheet having a thickness of 0.4 mm as an oxygen gas electrode.

The foregoing anode was placed in close contact with an ion exchange membrane (Nafion 117, produced by Du Pont Inc.). The foregoing oxygen gas electrode was arranged such that the distance between the oxygen gas electrode and the anode electrode was 5 mm. As a result, an electrolytic cell shown in FIG. 1 having an effective electrolysis area of 150 cm$^2$ and comprising an anode chamber and a cathode chamber (solution chamber and gas chamber) was assembled.

An electric current of 10A was passed through the anode and the cathode while the oxygen gas obtained from a PSA device, seawater having an organic compound concentration of 10 ppb and tap water having a chloride ion concentration of 20 mg/l and a TOC of 1 ppm were supplied to the gas chamber, the solution chamber and the anode chamber at a rate of 100 ml/min, 100 ml/l and 50 ml/l, respectively. As a result, seawater having a hydrogen peroxide content of 1,000 ppm was obtained at the outlet of the solution chamber at a current efficiency of about 95% when the cell voltage was 7.5 V.

The effective chlorine concentration of tap water at the outlet of the anode chamber was 15 ppm. The current efficiency was 0.3%.

Under these conditions, operation of the electrolytic cell was continued for 1,000 hours. As a result, the current efficiency in the production of hydrogen peroxide solution decreased to 90% and the cell voltage rose to 8 V. However, the electrolytic production of hydrogen peroxide continued. The effective chlorine concentration of tap water and current efficiency at the outlet of the anode chamber were 15 ppm and 0.3%, respectively, showing no change. The concentration of THM at the outlet of the solution chamber fell below the limit of detection (0.5 ppb).

EXAMPLE 2

An electrolytic cell was assembled in the same manner as in Example 1, except that an anode obtained by subjecting a porous titanium sheet to electrodeposition in an acidic aqueous solution of manganese sulfate to support a manganese dioxide catalyst thereon in an amount of 50 g/m$^2$ was used. Electrolysis was effected using this electrolytic cell.

Seawater having a hydrogen peroxide content of 1,000 ppm was obtained at the outlet of the solution chamber at a current efficiency of about 95%. The effective chlorine concentration of tap water at the outlet of the anode chamber was not greater than 1 ppm. At this point, the concentration of THM at the outlet of the solution chamber fell below the limit of detection.

EXAMPLE 3

An electrolytic cell was assembled in the same manner as in Example 1, except that as the anolyte supplied to the anode chamber was industrial water having a chloride ion concentration of 20 ppm and TOC of 2 ppm. Electrolysis was effected using this electrolytic cell.

Seawater having a hydrogen peroxide content of 1,000 ppm was obtained at the outlet of the solution chamber at a current efficiency of about 95%. The effective chlorine concentration of tap water at the outlet of the anode chamber was not greater than 50 ppm. The cell voltage was 7.5 V. At this point, the concentration of THM at the outlet of the solution chamber fell below the limit of detection.

EXAMPLE 4

An electrolytic cell was assembled in the same manner as in Example 1, except that sodium chloride was dissolved in tap water supplied to the anode chamber so that the chloride ion concentration of the tap water was about 1 g/l. Electrolysis was effected using this electrolytic cell.

Seawater having a hydrogen peroxide content of 1,000 ppm was obtained at the outlet of the solution chamber at a current efficiency of about 95%. The effective chlorine concentration of tap water at the outlet of the anode chamber was not greater than 300 ppm. The cell voltage was 7.0 V. At this point, the concentration of THM at the outlet of the solution chamber was 1 ppb.

Comparative Example 1

A hydrogen peroxide solution was produced in the same manner as in Example 1, except that seawater was supplied to the anode chamber at a rate of 50 ml/min instead of tap water.

The cell voltage was 5.5 V. Seawater having a hydrogen peroxide content of 900 ppm was obtained at the outlet of the solution chamber at a current efficiency of about 80%. The concentration of THM in the seawater was 10 ppb. The effective chlorine concentration and THM concentration of seawater at the outlet of the anode chamber were 3,500 ppm and 100 ppb, respectively.

The invention provides a process for producing a hydrogen peroxide solution which comprises effecting electrolysis while supplying an anolyte, a catholyte and an oxygen-containing gas to an anode chamber housing an insoluble anode, a solution chamber and a gas chamber, respectively. The electrolysis is carried out in a hydrogen peroxide producing electrolytic cell partitioned by a membrane into an anode chamber and a cathode chamber housing a gas diffusion cathode, the gas diffusion cathode partitioning the cathode chamber into the solution chamber and the gas chamber. The catholyte supplied to the solution chamber is seawater, and the concentration of halide ion in the anolyte is not greater than 1 g/l. The anolyte supplied to the anode chamber is preferably industrial water or tap water.

Unlike conventional processes, the process of the invention suppresses the anodic oxidation of halide ions. This is achieved by restricting the amount of halide ion in the anode chamber, which would otherwise cause the production of organic halogen compounds, to a low concentration of not greater than 1 g/l. Accordingly, the process of the invention is hardly subject to the production of harmful amounts of effective chlorine or organic halogen compound in the anode chamber, making it possible to obtain a hydrogen peroxide solution that is harmless to environment and human body.

When electrolysis is effected while continuously supplying anolyte to the anode chamber, the concentration of halide ion accumulating in the anolyte and passing through the anode chamber can be kept as low as not greater than 1 g/l, making it possible to avoid the production of harmful materials by anodic oxidation.

By mixing the anolyte withdrawn from the electrolytic cell with catholyte containing hydrogen peroxide withdrawn from the electrolytic cell, a slight amount of effective chlorine remaining in the anolyte is decomposed by the hydrogen peroxide, making it possible to remove harmful materials more effectively.

While the invention has been described in detail and with reference to specific embodiments thereof, it will be apparent to one skilled in the art that various changes and modifications can be made therein without departing from the spirit and scope thereof.

This application is based on Japanese Patent Application No. 2001-72091 filed Mar. 14, 2001, the disclosure of which is incorporated herein by reference in its entirety.

What is claimed is:

1. A process for the production of hydrogen peroxide solution which comprises:

providing an electrolytic cell partitioned by a membrane into an anode chamber housing an insoluble anode and a cathode chamber housing a gas diffusion cathode, said gas diffusion cathode partitioning said cathode chamber into a solution chamber and a gas chamber located on a side of the solution chamber opposite the anode chamber;

supplying an anolyte having a halide ion concentration of not greater than 1 g/l to the anode chamber, a catholyte comprising seawater to the solution chamber, and an oxygen-containing gas to the gas chamber;

passing electric current through the electrolytic cell to effect electrolysis and thereby generate hydrogen peroxide which dissolves in said catholyte; and recovering hydrogen peroxide solution from said solution chamber, said process further comprising withdrawing anolyte from the anode chamber, withdrawing catholyte from the solution chamber, and mixing anolyte withdrawn from the anode chamber and catholyte withdrawn from the solution chamber to thereby decompose effective chlorine generated by anodic oxidation of chloride ion in the anode chamber by reaction with hydrogen peroxide contained in the withdrawn catholyte.

2. The process as claimed in claim 1, wherein said anolyte is industrial water or tap water.

3. The process as claimed in claim 1, which comprises effecting electrolysis while continuously supplying anolyte to the anode chamber.

4. The process as claimed in claim 3, which comprises supplying the anolyte to the anode chamber at a rate which maintains the halide ion concentration in the anode chamber to a level not greater than 1 g/l.

5. The process as claimed in claim 1, which comprises supplying seawater treated to remove organic compounds to the solution chamber.

6. The process as claimed in claim 1, which comprises mixing withdrawn anolyte and withdrawn catholyte outside the electrolytic cell.

* * * * *